US009194176B2

(12) United States Patent
Chen

(10) Patent No.: US 9,194,176 B2
(45) Date of Patent: Nov. 24, 2015

(54) DAMPING POSITIONER

(71) Applicant: Hsiao-Yin Chen, New Taipei (TW)

(72) Inventor: Hsiao-Yin Chen, New Taipei (TW)

( * ) Notice: Subject to any disclaimer, the term of this patent is extended or adjusted under 35 U.S.C. 154(b) by 49 days.

(21) Appl. No.: 14/136,929

(22) Filed: Dec. 20, 2013

(65) Prior Publication Data

US 2015/0176331 A1 Jun. 25, 2015

(51) Int. Cl.

| | |
|---|---|
| ***E06B 9/60*** | (2006.01) |
| ***E06B 9/42*** | (2006.01) |
| ***E06B 9/80*** | (2006.01) |

(52) U.S. Cl.

CPC ... *E06B 9/42* (2013.01); *E06B 9/60* (2013.01); *E06B 9/80* (2013.01); *E06B 2009/807* (2013.01)

(58) Field of Classification Search

CPC ..... E06B 9/40; E06B 9/56; E06B 9/80; E06B 9/82; E06B 9/84; E06B 9/88; E06B 9/90; E06B 2009/807

See application file for complete search history.

(56) References Cited

U.S. PATENT DOCUMENTS

| | | | | |
|---|---|---|---|---|
| 1,786,512 | A * | 12/1930 | Whitworth | 160/295 |
| 2,020,595 | A * | 11/1935 | Weber | 160/295 |
| 3,965,960 | A * | 6/1976 | Massey | 160/295 |
| 4,513,805 | A * | 4/1985 | Mase | 160/299 |
| 6,443,210 | B1 * | 9/2002 | Welfonder | 160/313 |
| 7,706,067 | B2 * | 4/2010 | Liang | 359/461 |
| 7,985,157 | B2 * | 7/2011 | Yang | 475/260 |
| 8,051,960 | B2 * | 11/2011 | Nakajima | 188/82.7 |
| 8,357,066 | B2 * | 1/2013 | Lee et al. | 475/261 |
| 2009/0318258 | A1 * | 12/2009 | Yang | 475/343 |
| 2010/0243394 | A1 * | 9/2010 | Lee et al. | 192/43.1 |
| 2015/0059992 | A1 * | 3/2015 | Liu | 160/313 |

* cited by examiner

*Primary Examiner* — Katherine Mitchell
*Assistant Examiner* — Scott Denion
(74) *Attorney, Agent, or Firm* — Muncy, Geissler, Olds & Lowe, P.C.

(57) ABSTRACT

A damping positioner is installed in a headrail track of an automatic roll-up blind and works with an automatic winding mechanism of the roll-up blind. The damping positioner includes a positioner that is disposed in the headrail track as well as a damper that is connected at an end of the positioner and is able to rotate freely. An interior of the damper is provided with a spring assembly, a gear assembly and a brake set. The winding speed of the roll-up blind is controlled by the gear assembly and the brake set, such that the roll-up blind can be rolled up moderately. Moreover, the damping positioner is installed in the headrail track without being exposed; therefore, the integrity of appearance of the roll-up blind can be reserved.

11 Claims, 9 Drawing Sheets

DAMPING POSITIONER

BACKGROUND OF THE INVENTION a) Field of the Invention

The present invention relates to a damping positioner, and more particularly to a damping positioner that is used in a headrail track of an automatic roll-up blind and works with an automatic winding mechanism (i.e., torsional spring device), thereby controlling the winding speed of the roll-up blind and the final stop location of the roll-up blind after rolling up the roll-up blind.

b) Description of the Prior Art

There are two kinds of roll-up blinds in the market: a manual roll-up blind, and an automatic roll-up blind.

The manual roll-up blind is provided with a winding mechanism and a loop-shaped cord at a side of the roll-up blind. The loop-shaped cord is pulled repeatedly by both hands to drive the headrail track of the roll-up blind, such that the curtain that is connected with the headrail track can be driven to roll upward or expand downward.

On the other hand, the automatic roll-up blind is provided with an automatic winding mechanism and a stop device at each end of the headrail track, respectively. The headrail track is driven by the automatic winding mechanism, such that the curtain that is connected with the headrail track can be driven to roll upward.

The existing automatic winding mechanism uses primarily the elastic restoration of the torsional spring to drive the headrail track and the connected curtain, such that the curtain can be expanded downward and rolled upward. Firstly, the torsional spring is set up and tightened to a specific position in advance according to the weight of the curtain used, thereby driving the headrail track to rotate and roll up the curtain that is connected with the track successfully. When the curtain is expanded downward, the spring in the headrail track will rotate more tightly. On the contrary, when the spring is loosened, the elastic restoration will drive the headrail track again to rotate to the pre-determined location and roll up the connected curtain, thereby achieving the effect of automatically rolling up the curtain.

According to the above description, the existing automatic winding mechanism uses primarily the torsional spring to drive the headrail track and the connected curtain to rotate. However, if the elastic restoration force of the torsional spring is too large, then the curtain can be easily rolled up too fast, which results in collision and gives out unpleasant noises. Moreover, this collision can damage the blind and hurt a user accidentally. On the contrary, if the elastic restoration force of the torsional spring is too small, then the curtain cannot be rolled up successfully.

Accordingly, how to control the winding speed of the roll-up blind is an issue to be solved for blind manufacturers.

SUMMARY OF THE INVENTION

Accordingly, the primary object of the present invention is to provide a damping positioner, and more particularly a damping positioner that is used in a headrail track of an automatic roll-up blind and works with an automatic winding mechanism (i.e., torsional spring device), so as to control the winding speed of the roll-up blind and the final stop location of the roll-up blind after rolling up the roll-up blind.

To achieve the abovementioned object, the damping positioner of the present invention includes a positioner that is disposed in the headrail track as well as a damper that is connected at an end of the positioner and is able to rotate freely. The damper includes a movable cap which is pivoted at an end of the positioner and is linked with the positioner; a spring assembly which is provided with a connecting rod, an end of the connecting rod being connected with the movable cap, a spring which is sheathed at another end of the connecting rod, and a collar which is sheathed outside the connecting rod and the spring; a gear assembly which is disposed at another side of the collar of the spring assembly opposite to the connecting rod; a brake set which is disposed at another side of the gear assembly opposite to the connecting rod; an outer cap which is sheathed outside the spring assembly, the gear assembly and the brake set, with an end of the outer cap being pivoted on the movable cap and rotating on the movable cap; and a fixed cap which is fixed at another side of the outer cap opposite to the movable cap.

An interior of the outer cap, opposite to the gear assembly, is further provided annularly with a thread, allowing the outer cap to be linked with the gear assembly.

An end of the collar of the spring assembly, in proximity to the gear assembly, is further protruded with plural first positioning rods.

The gear assembly further includes a first gear set which is composed of a first driving plate and plural first gears, wherein and end of the first driving plate in proximity to the first positioning rods is extended toward the first positioning rods with a first driving wheel, with the first driving wheel and the first gears being gnawed together and sheathed on the first positioning rods.

Another end of the first driving plate away from the first positioning rods is further protruded with plural second positioning rods. The gear assembly further includes a second gear set which is composed of a second driving plate and plural second gears. An end of the second driving plate in proximity to the second positioning rods is extended toward the second positioning rods with a second driving wheel, with the second driving wheel and the second gears being gnawed together and sheathed on the second positioning rods.

Another end of the second driving plate away from the second positioning rods is further protruded with at least a support rod; whereas, the brake set is sheathed on the support rod, swings inside the outer cap against the support rod and rubs with an interior of the outer cap.

The winding speed of the automatic winding mechanism (i.e., torsional spring device) at another end inside the headrail track of a roll-up blind is controlled by the gear assembly and the brake set, allowing the roll-up blind to be rolled up moderately. On the other hand, as the damping positioner is installed in the headrail track without being exposed, the integrity of appearance of the roll-up blind can be reserved.

Another object of the damping positioner of the present invention is to adjust the final stop location of the roll-up blind after rolling up the roll-up blind, such that the roll-up blind will not be rolled up completely to a top end, but will stop at a specified location from the top end. Therefore, the stop location after rolling up the roll-up blind can be set up according to a user's preference, which further solves a trouble that when completely rolling up the roll-up blind that is installed at a higher window, the user cannot touch the roll-up blind with hands as the roll-up blind is too high, but instead has to climb high using a stool or a ladder that he or she can touch and expand the roll-up blind again.

To achieve the above object, the positioner of the present invention further includes a fixed base, a fixed rod and a fixed ring. An end of the fixed base is provided with a through-hole and another end of the fixed base is provided with a fixed plate. The fixed rod is transfixed in the through-hole of the fixed base, and is extended toward the fixed plate of the fixed base with a screw. A tail end of the screw is clipped on the fixed plate and the fixed ring is locked on the screw of the fixed rod.

Another end of the screw opposite to the fixed rod is further extended with a pivoting member which is fixed on the movable cap of the damper.

Another end of the fixed rod opposite to the screw is indented with an adjustment slot.

The positioner further includes a tail-plug fixed base, and the tail-plug fixed base is extended toward an interior of the adjustment slot with a protection bump which can be locked into the adjustment slot.

The positioner further includes an O-ring, and the O-ring is sheathed at an engagement place between the fixed rod and the screw.

Accordingly, a tool or a Philips screw driver can be inserted into the adjustment slot to rotate the fixed rod, thereby driving the screw. In addition, the fixed ring will be driven by the screw to stay on any location of the screw, thereby achieving the effect of adjusting the final stop location after rolling up the roll-up blind.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
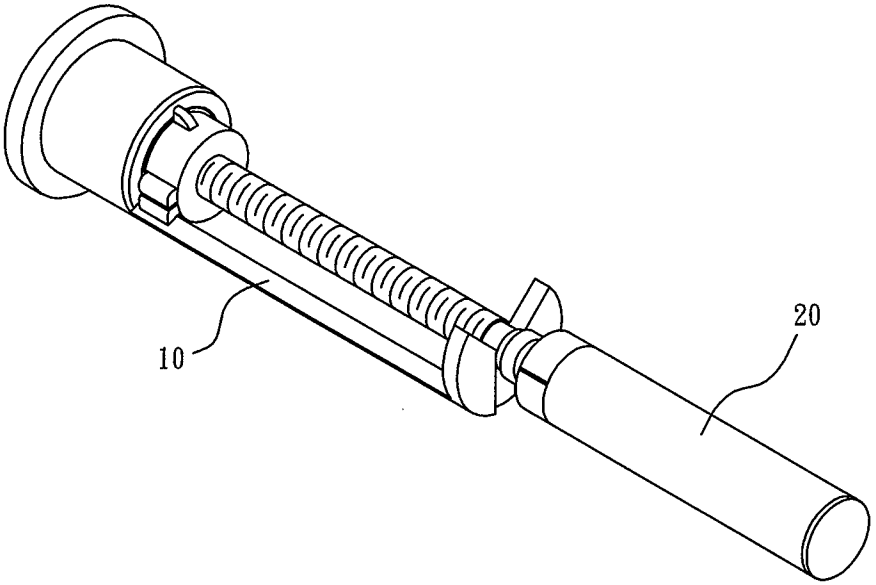
FIG. 1 shows a schematic view of the present invention.
Figure 2:
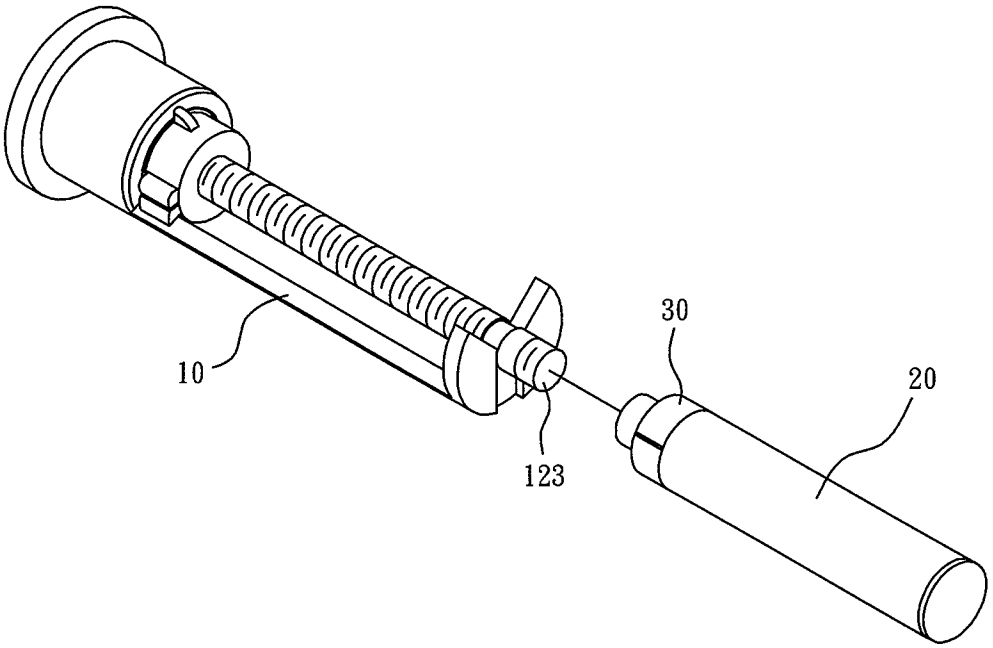
FIG. 2 shows an exploded view of the present invention.

Referring to FIG. 1 and FIG. 2, the damping positioner of the present invention is disposed in a headrail track of a roll-up blind (not shown in the drawings as it belongs to a prior art), and comprises primarily a positioner 10 and a damper 20. The positioner 10 is disposed in the headrail track; whereas, the damper 20 is connected at another end of the positioner 10.

Figure 3:
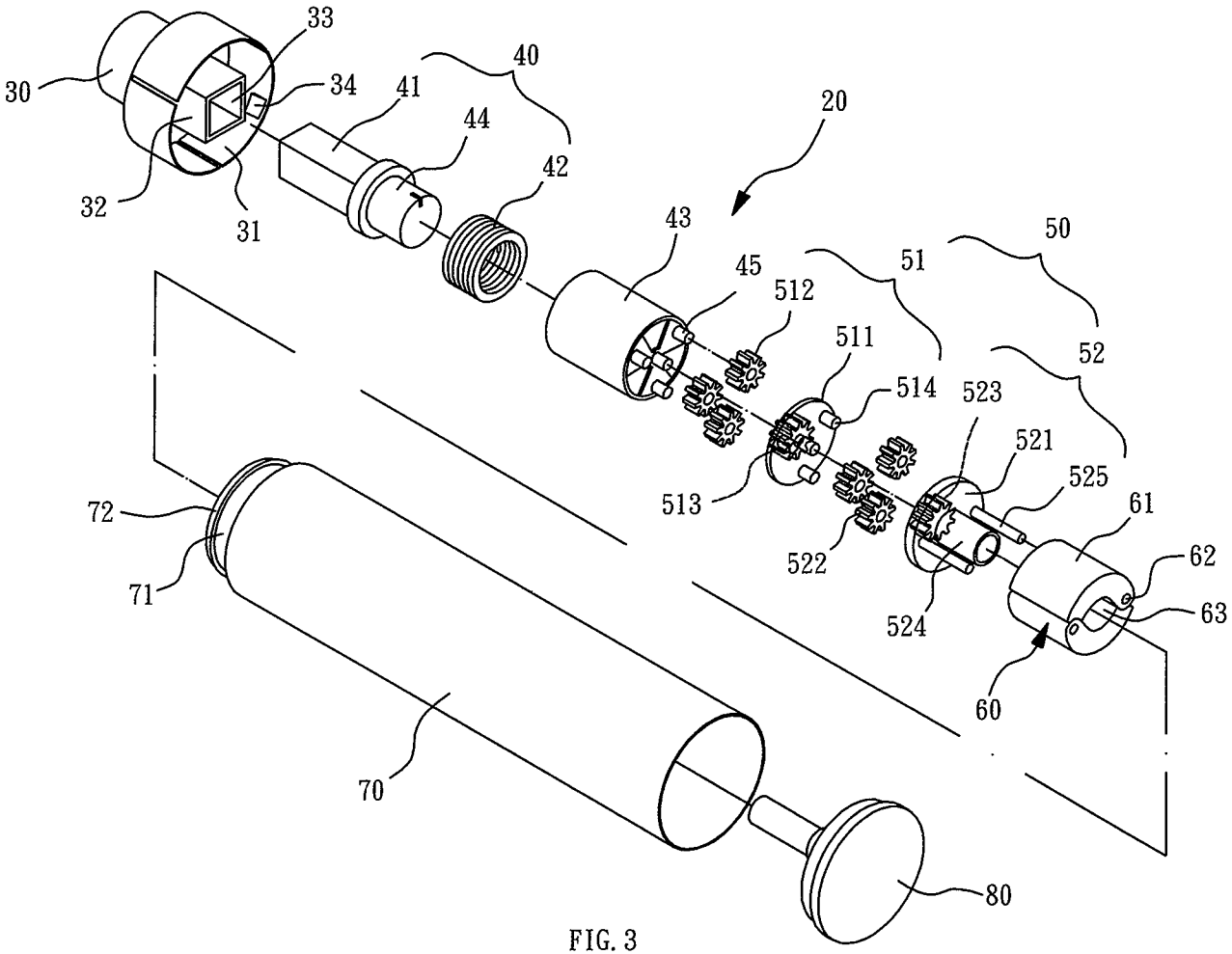
FIG. 3 shows an exploded view of a damper of the present invention.
Figure 4:
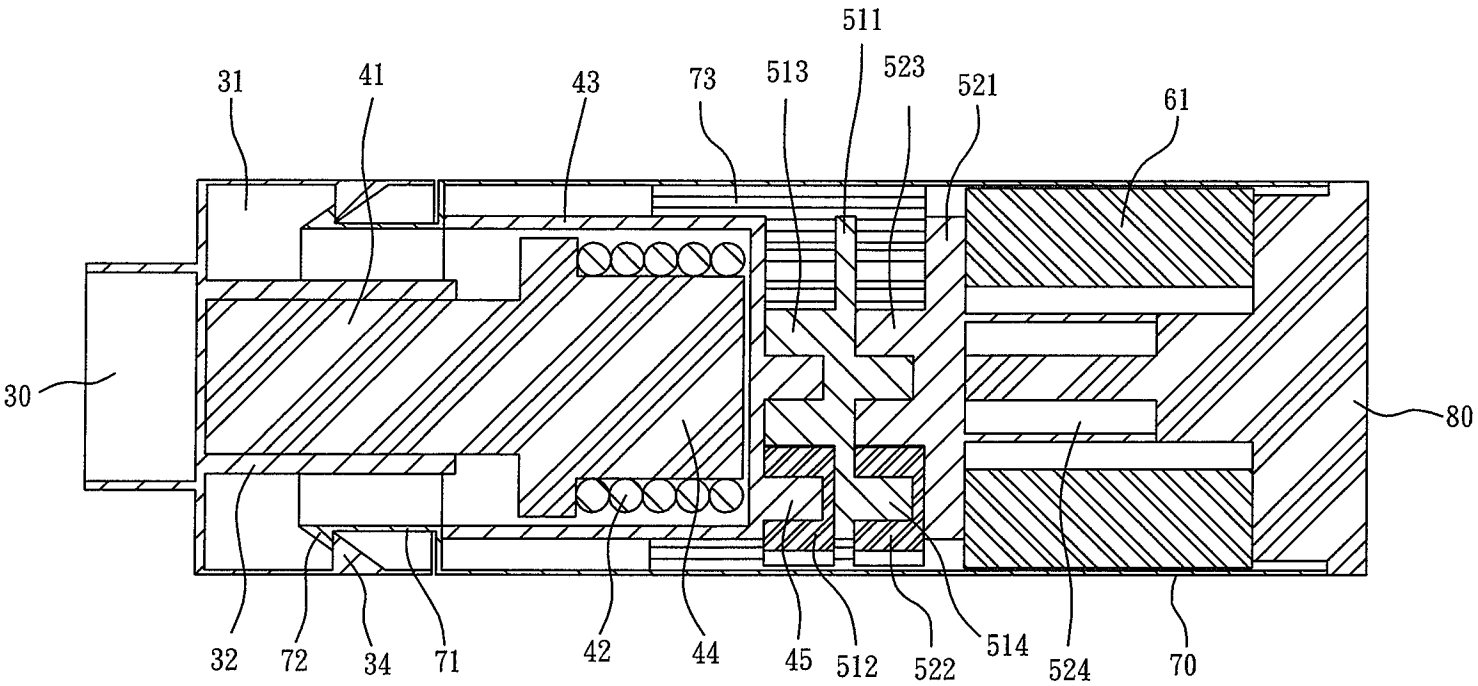
FIG. 4 shows a first cutaway view of the damper of the present invention.

Referring to FIG. 3 and FIG. 4, the damper 20 includes a movable cap 30, a spring assembly 40, a gear assembly 50, a brake set 60, an outer cap 70 and a fixed cap 80.

An end of the movable cap 30 is connected with the positioner 10 (as shown in FIG. 1); whereas, another end of the movable cap 30 is provided with a containing space 31. A center of the containing space 31 is protruded with a protruded member 32, an interior of the protruded member 32 is provided with a square-shaped slot 33, and a side wall of the containing space 31 is protruded with at least a latch block 34.

The spring assembly 40 is provided with a connecting rod 41, an end of which being connected at the movable cap 30; a spring 42 which is sheathed at another end of the connecting rod 41; and a collar 43 which is sheathed outside the connecting rod 41 and the spring 42. The connecting rod 41 is in a shape of a square body and is inserted in the slot 33 of the movable cap 30; whereas, another end of the connecting rod 41 away from the movable cap 30 is provided with a pillar 44. The spring 42 is sheathed outside the pillar 44 and is used to produce an elastic restoration force. An interior of the collar 43 is empty and is sheathed outside the pillar 44 and the spring 42; whereas, an end surface on a side of the collar 43 away from the connecting rod 41 is protruded outward with plural first positioning rods 45.

The gear assembly 50 is disposed at another side of the collar 43 of the spring assembly 40 away from the connecting rod 41, and includes a first gear set 51 and a second gear set 52. The first gear set 51 is composed of a first driving plate 511 and plural first gears 512. An end of the first driving plate 511 in proximity to the first positioning rods 45 is protruded toward the first positioning rods 45 with a first driving wheel 513. The first driving wheel 513 and plural first gears 512 are gnawed together and sheathed on the first positioning rods 45; whereas, another end of the first driving plate 511 away from the first positioning rods 45 is further protruded with plural second positioning rods 514.

The second gear set 52 is composed of a second driving plate 521 and plural second gears 522. An end of the second driving plate 521 in proximity to the second positioning rods 514 is protruded toward the second positioning rods 514 with a second driving wheel 523. The second driving wheel 523 and the second gears 522 are gnawed together and sheathed on the second positioning rods 514; whereas, another end of the second driving plate 521 away from the second positioning rods 514 is further protruded with a central shaft 524 and at least a support rod 525. In the present embodiment, there are two support rods 525.

The brake set 60 is disposed at another end of the gear assembly 40 away from the connecting rod 41 and is composed of two brake pads 61 in the present embodiment, wherein each brake pad 61 is in a shape of a crescent and a side of the brake pad 61 is provided with a borehole 62 which is sheathed on the support rod 525, such that each brake pad 61 can swing against the support rod 525. Additionally, a through-hole 63 is formed between the two brake pads 61 and is sheathed outside the central shaft 524 of the second driving plate 521.

The outer cap 70 is sheathed outside the spring assembly 40, the gear assembly 50 and the brake set 60. An end of the outer cap 70 in proximity to the movable cap 30 is protruded toward the movable cap 30 with a protruded member 71. The protruded member 71 is protruded into the containing space 31 of the movable cap 30, and a front edge of the protruded member 71 is formed with a latch member 72. The latch member 72 is a little larger than the protruded member 71, therefore the latch member 72 can be fastened with the latch block 34 of the movable cap 30, and the outer cap 70 can be pivoted on the movable cap 30 and rotate on the movable cap 30. Furthermore, an interior of the outer cap 70 opposite to the gear assembly 50 is further provided annularly with a thread 73 which can be gnawed with the first gears 512 and the second gears 522.

The fixed cap 80 is fixed at another end of the outer cap 70 away from the movable cap 30, allowing the spring assembly 40, the gear assembly 50 and the brake set 60 to be actually installed in the outer cap 70.

Figure 5:
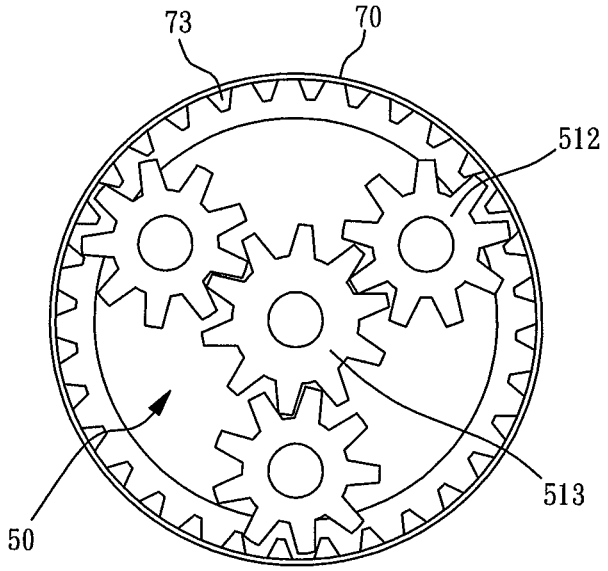
FIG. 5 shows a cutaway view of the damper relative to a first gear set, according to the present invention.

Referring to FIG. 5, as the interior of the outer cap 70 opposite to the gear assembly 50 is provided annularly with the thread 73, the first driving wheel 513, plural first gears 512 and the thread 73 of the outer cap 70 will be gnawed with one another. When the first driving wheel 513 rotates, the first gears 512 will be driven, and then the outer cap 70 will be driven to rotate by the first gears 512, allowing the outer cap 70 to reduce the rotation speed of the headrail track. Besides that, through the gnawing among the first driving wheel 513, plural first gears 512 and the thread 73, the outer cap 70 can rotate more smoothly, allowing the curtain to be rolled up more steadily.

Figure 6:
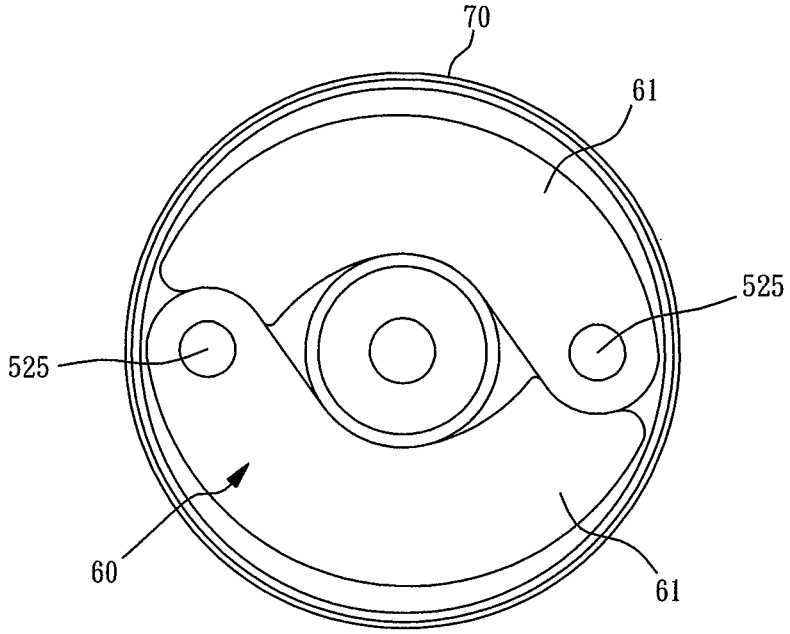
FIG. 6 shows a cutaway view of a first location of a brake set, according to the present invention.
Figure 7:
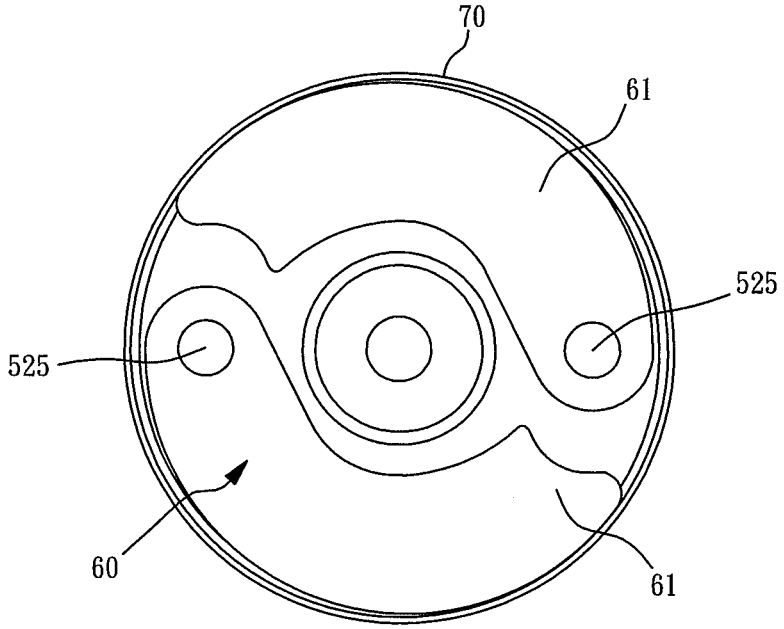
FIG. 7 shows a cutaway view of a second location of the brake set, according to the present invention.

Referring to FIG. 6 and FIG. 7, the brake set 60 includes primarily two brake pads 61 and each brake pad 61 will swing inside the outer cap 70 against the support rod 525. Therefore, when the outer cap 70 rotates, each brake pad 61 will swing outward against the support rod 525 by the centrifugal force, allowing the brake pads 61 to rub with an inner side of the outer cap 70, so as to decrease the rotation speed of the outer cap 70 and slow down the winding speed of the automatic winding mechanism (i.e., torsional spring device) at another end in the headrail track, in order to achieve the braking effect while controlling the winding of the roll-up blind. In the present embodiment, two brake pads 61 are used as an example, but in practical operations, there can be one or three or more brake pads 61.

Accordingly, the winding speed of the automatic winding mechanism (i.e., torsional spring device) at another end in the headrail track of the roll-up blind is controlled by the gear assembly 50 (as shown in FIG. 5) and the brake set 60, allowing the roll-up blind to be rolled up moderately. In addition, as the damping positioner is installed in the headrail track without being exposed, the integrity of appearance of the roll-up blind can be reserved.

Figure 8:
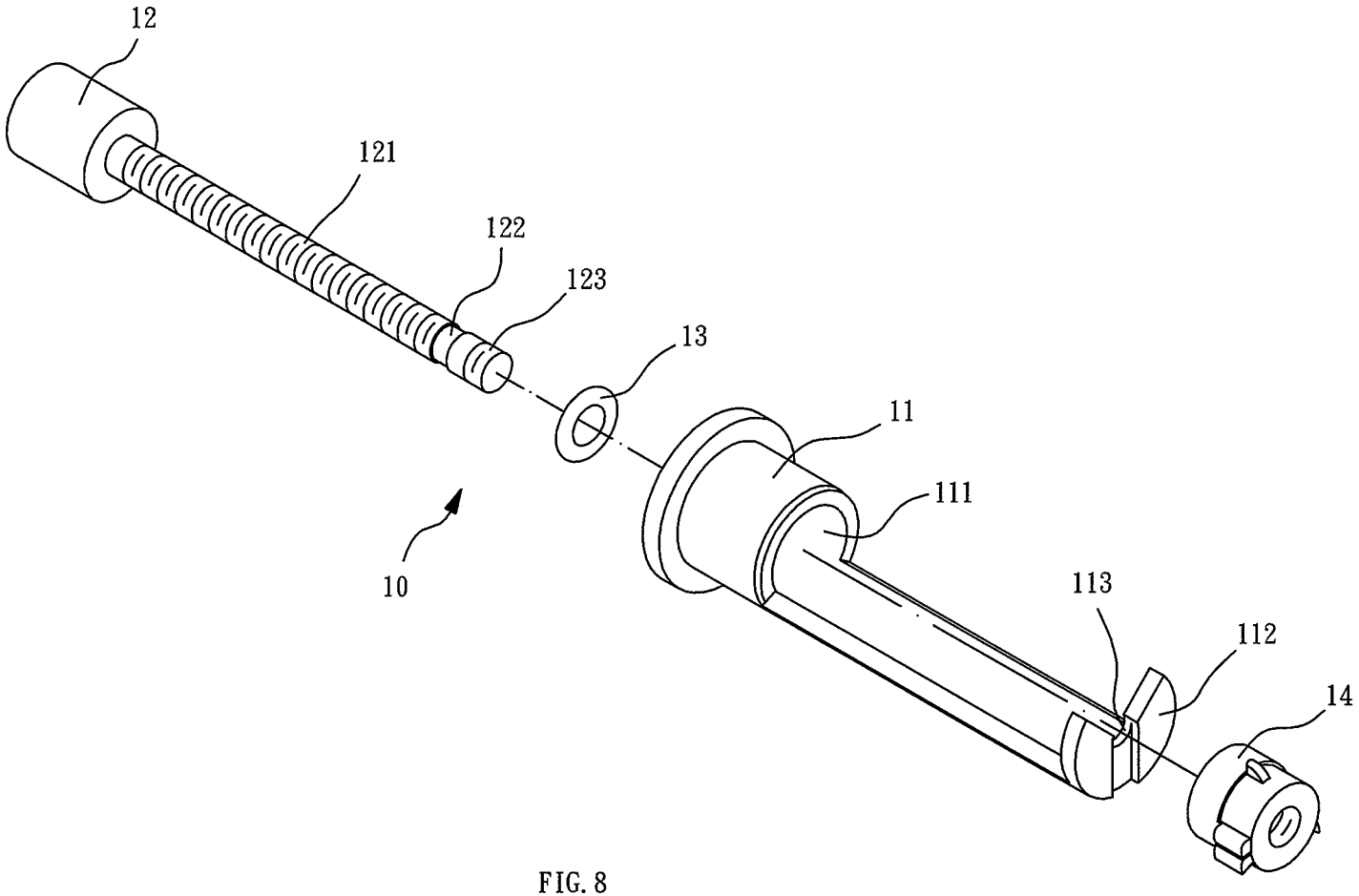
FIG. 8 shows an exploded view of a positioner of the present invention.
Figure 9:
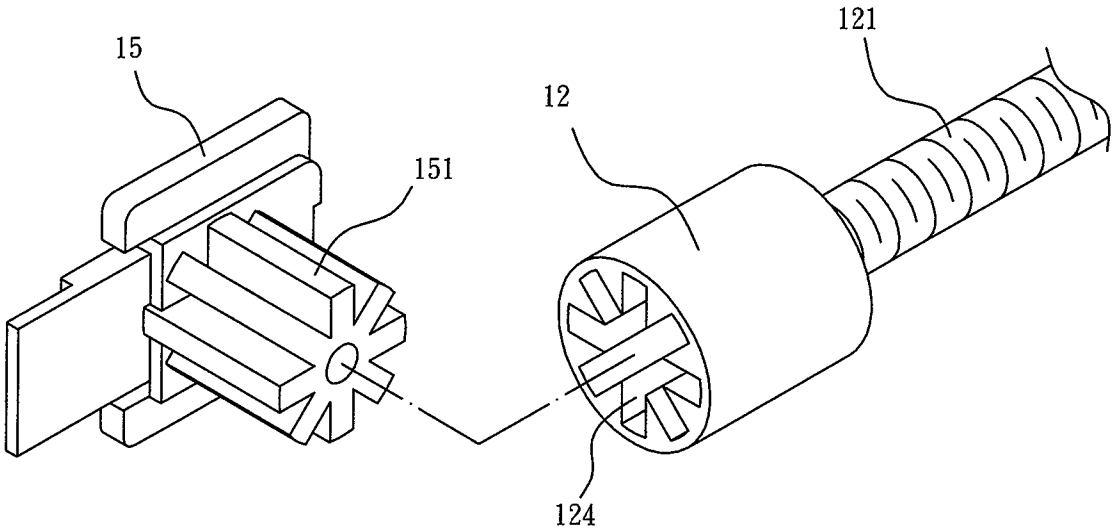
FIG. 9 shows a schematic view of a second embodiment of the positioner, according to the present invention.

Referring to FIG. 8 and FIG. 9, the positioner 10 further includes a fixed base 11, a fixed rod 12, an O-ring 13 and a fixed ring 14.

An end of the fixed base 11 is provided with a through-hole 111, and another end of the fixed base 11 is extended outward with a fixed plate 112. The fixed plate 112 is provided with a fixed hole 113, and the fixed rod 12 is transfixed in the through-hole 111 of the fixed base 11. A side of the fixed rod 12 is extended with a screw 121. A tail end 122 of the screw 121 is clipped in the fixed hole 113 on the fixed plate 112 and is further extended outward with a pivoting member 123. The O-ring 13 is sheathed at an engagement place between the fixed rod 12 and the screw 121; whereas, the fixed ring 14 is locked on the screw 121 of the fixed rod 12, and can rotate by the screw 121 to displace on the screw 121.

Moreover, a side of the fixed rod 12 away from the screw 121 is indented with an adjustment slot 124, and the positioner 10 further includes a tail-plug fixed base 15 which is locked on a wall bracket (not shown in the drawings as it belongs to a prior art) used to fix the roll-up blind on the wall. A side of the tail-plug fixed base 15 is extended with a protection bump 151 which can be locked into the adjustment slot 124 of the fixed rod 12. The fixed rod 12 can be fixed by locking the protection bump 151 into the adjustment slot 124, which prevents from being unable to set up the damping positioner caused by rotating the screw 121 accidentally.

A tool or a Phillips screwdriver (not shown in the drawings) can be inserted into the adjustment slot 124 and then rotates to drive the screw 121. Referring to FIG. 2 at a same time, the rotation of the screw 121 will drive the fixed ring 14 to displace, and when the fixed ring 14 is located very close to the engagement place between the fixed rod 12 and the screw 121, the roll-up blind will be completely rolled up to a top end. On the other hand, when the fixed ring 14 is adjusted to move away from the fixed rod 12, the final stop location of the roll-up blind that has been rolled up will be also away from the top end. Therefore, by the adjustment with a tool or a Phillips screwdriver, the stop location after rolling up the roll-up blind can be set up according to a user's preference, thereby solving the trouble that when completely rolling up the roll-up blind which is installed at a higher window, the user cannot touch the roll-up blind with hands as the roll-up blind is too high, but instead has to climb high using a stool or a ladder that he or she can touch and expand the roll-up blind again.

Moreover, when the tool is removed, the protection bump 151 of the tail-plug fixed base 15 can be plugged into the adjustment slot 24 to prevent from rotating the screw 121 accidentally and to protect the integrity of the adjustment slot 124.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A damping positioner being installed in a headrail track of a roll-up blind and comprising:

a positioner, the positioner is disposed in the headrail track; and a damper, the damper is connected at an end of the positioner and includes:

a movable cap, the movable cap is pivoted at the end of the positioner and is linked with the positioner;

a spring assembly, the spring assembly is provided with a connecting rod, with one end of the connecting rod being connected at the movable cap, and a spring which is sheathed at another end of the connecting rod by a collar which encloses the connecting rod and the spring;

a gear assembly, the gear assembly is disposed adjacent to the collar of the spring assembly opposite the connecting rod in a longitudinal direction;

a brake set, the brake set is disposed adjacent to the gear assembly opposite the collar in the longitudinal direction;

an outer cap, wherein the outer cap encloses the spring assembly, the gear assembly and the brake set, with an end of the outer cap being pivoted on the movable cap and rotating on the movable cap, and wherein the gear assembly and the brake set engage directly with the outer cap; and a fixed cap, the fixed cap is fixed at another end of the outer cap opposite the movable cap.

2. The damping positioner according to claim 1, wherein an interior of the outer cap, surrounding the gear assembly, is further provided annularly with a thread allowing the outer cap to engage with the gear assembly.

3. The damping positioner according to claim 1, wherein an end of the collar of the spring assembly, in proximity to the gear assembly, further includes plural first positioning rods protruding towards the gear assembly.

4. The damping positioner according to claim 3, wherein the gear assembly includes a first gear set, the first gear set comprises a first driving plate and plural first gears, one end of the first driving plate in proximity to the first positioning rods is connected to a first driving wheel which extends towards the first positioning rods, the first driving wheel and the first gears engage each other and are sheathed on the first positioning rods.

5. The damping positioner according to claim 4, wherein another end of the first driving plate opposite the first positioning rods further includes plural second positioning rods protruding away from the first gear set, the gear assembly further includes a second gear set, the second gear set is composed of a second driving plate and plural second gears, one end of the second driving plate in proximity to the second positioning rods is connected to second driving wheel which extends towards the first positioning rods, the second driving wheel and the second gears engage each other and are sheathed on the second positioning rods.

6. The damping positioner according to claim 5, wherein another end of the second driving plate opposite the second positioning rods further includes a support rod protruding away from the second gear set, and the brake set being sheathed on the support rod.

7. The damping positioner according to claim 1, wherein the positioner further includes a fixed base, a fixed rod and a fixed ring, one end of the fixed base is provided with a through-hole, another end of the fixed base is provided with a fixed plate, the fixed plate is transfixed in the through-hole of the fixed base, the fixed rod includes a screw extending towards the fixed plate of the fixed base, a tail end of the screw is clipped on the fixed plate, and the fixed ring is locked on the screw of the fixed rod.

8. The damping positioner according to claim 7, wherein another end of the screw opposite the fixed rod further includes a pivoting member, and the pivoting member is fixed to the movable cap of the damper.

9. The damping positioner according to claim 7, wherein one end of the fixed rod opposite to the screw is indented with an adjustment slot.

10. The damping positioner according to claim 9, wherein the positioner further includes a tail-plug fixed base and the tail-plug fixed base extends towards an interior of the adjustment slot with a protection bump which is locked into the adjustment slot.

11. The damping positioner according to claim 7, wherein the positioner further includes an O-ring and the O-ring sheaths an engagement place between the fixed rod and the screw.

* * * * *